US007723000B2

(12) United States Patent
Suzuki et al.

(10) Patent No.: US 7,723,000 B2
(45) Date of Patent: May 25, 2010

(54) ELECTROPHOTOGRAPHIC PHOTOCONDUCTOR

(75) Inventors: Shinjirou Suzuki, Matsumoto (JP); Yoichi Nakamura, Matsumoto (JP); Ikuo Takaki, Matsumoto (JP); Kazuki Nebashi, Matsumoto (JP)

(73) Assignee: Fuji Electric Device Technology Co., Ltd., Tokyo (JP)

( * ) Notice: Subject to any disclaimer, the term of this patent is extended or adjusted under 35 U.S.C. 154(b) by 640 days.

(21) Appl. No.: 11/641,949

(22) Filed: Dec. 20, 2006

(65) Prior Publication Data

US 2007/0154827 A1 Jul. 5, 2007

(30) Foreign Application Priority Data

Dec. 27, 2005 (JP) ..... 2005-376134

(51) Int. Cl.
*G03G 5/14* (2006.01)

(52) U.S. Cl. ..... 430/60; 430/65; 430/131

(58) Field of Classification Search ..... 430/60, 430/64, 131, 65
See application file for complete search history.

(56) References Cited

U.S. PATENT DOCUMENTS

| | | | | |
|---|---|---|---|---|
| 2,297,691 | A | 10/1942 | Carlson | |
| 5,104,757 | A * | 4/1992 | Koyama et al. | 430/60 |
| 7,166,398 | B2 * | 1/2007 | Itami et al. | 430/60 |

FOREIGN PATENT DOCUMENTS

| | | |
|---|---|---|
| JP | 51-114132 | 10/1976 |
| JP | 52-025638 | 2/1977 |
| JP | 58-095351 | 6/1983 |
| JP | 61-217050 | 9/1986 |
| JP | 63-298251 | 12/1988 |
| JP | 03-015851 | 1/1991 |
| JP | 05-034964 | 2/1993 |
| JP | 09-166882 | 6/1997 |
| JP | 11-015183 | 1/1999 |
| JP | 2003-287914 | 10/2003 |
| JP | 2004-175996 | 6/2004 |
| JP | 2005-113032 | 4/2005 |
| WO | WO 85/00437 | 1/1985 |

OTHER PUBLICATIONS

Lewis, R.J., Sr., ed., Hawley's Condensed Chemical Dictionary, 13th edition, Van Nostrand Reinhold, NY (1997), pp. 996-997.*

* cited by examiner

*Primary Examiner*—Janis L Dote
(74) *Attorney, Agent, or Firm*—Rabin & Berdo, PC

(57) ABSTRACT

An electrophotographic photoconductor includes an undercoat layer and a photosensitive layer sequentially provided on a conductive substrate. The undercoat layer is mainly composed of a resin and contains a metal oxide. The resin is provided by mixing and polymerizing raw materials of aromatic dicarboxylic acid in a range of 0.1 to 10 mol %, two or more types of dicarboxylic acid other than the aromatic dicarboxylic acid, two or more types of diamine, and at least one type of cyclic amide compound. The resin exhibits an acid value and a base value each of at most 6.0 KOH mg/g. Advantageously, generation of secondary aggregates in the undercoat layer, which result in image defects such as black spots and fogging on a white field, is suppressed.

20 Claims, 2 Drawing Sheets

ELECTROPHOTOGRAPHIC PHOTOCONDUCTOR

CROSS-REFERENCE TO RELATED APPLICATION

This application is based on and claims priority from Japanese Patent Application No. 2005-376134 filed on Dec. 27, 2005, the contents of which are incorporated herein by reference.

BACKGROUND OF THE INVENTION

1. Field of the Invention

The present invention relates to an electrophotographic photoconductor (hereinafter also simply referred to as "photoconductor"), in particular, to an electrophotographic photoconductor that is used in copiers, facsimile machines, printers, or the like electrophotographic apparatuses.

2. Description of the Related Art

Image formation using an electrophotographic system is diversely applied to copiers, printers, plotters and digital imaging complex machines combining functions of these machines in the office, and recently also to small-sized printers and facsimile machines for personal use. Many types of photoconductors for these electrophotographic apparatuses have been developed since the invention by C. F. Carlson, see U.S. Pat. No. 2,297,691. Photoconductors today generally use organic material.

There is a type of organic photoconductor using organic material which is a functionally separated photoconductor and which consists of an undercoat layer, a charge generation layer, a charge transport layer, and a protective layer that are laminated on a conductive substrate. The conductive substrate is made of aluminum or the like. The undercoat layer can be an anodic oxide film or a resin film. The charge generation layer contains an organic pigment exhibiting the photoconductive property such as phthalocyanines or azo pigments. The charge transport layer contains a molecule having a partial structure that involves hopping conduction of charges, such as a molecule of amine or hydrazone that bonds with conjugated $\pi$ electrons. Another type of known photoconductor, a single layer type photoconductor, comprises a photosensitive layer exhibiting both charge generating and charge transporting functions and a protective layer that are laminated on an undercoat layer.

Each layer is normally formed, because of mass-production, by dipping and coating a conductive substrate in a coating liquid prepared by dissolving or dispersing a pigment, a charge generation agent, to exhibit a charge generation or light scattering function, and a charge transport agent to exhibit a charge transport function.

In a so-called reverse development process that is primarily employed in recent electrophotographic apparatuses, an exposure light source uses a semiconductor laser or a light emitting diode with an oscillation wave length ranging from 450 nm to 780 nm; digital signals of a picture or characters are transformed into optical signals; the light is irradiated on an electrified photoconductor to form a latent electrostatic image on the photoconductor surface; and the latent image in turn is made visible by toner.

Among charge generation agents, phthalocyanines have been extensively studied as a material for a photosensitive layer because the phthalocyanines have a larger light absorbing capability in the oscillation wavelength region of semiconductor lasers than other charge generation agents and thus exhibit excellent charge generation ability. Known photoconductors use a variety of phthalocyanines having a central atom of copper, aluminum, indium, vanadium, or titanium.

There are two methods for electrifying a photoconductor: a non-contact electrification method by means of corona discharge from a scorotron in which the electrifying member is not in contact with the photoconductor, and a contact electrification method by means of a roller of conductive rubber or a brush of conductive fibers in which the electrifying member is in contact with the photoconductor. The contact electrification method has advantages, compared with the non-contact electrification method, including less generation of ozone because of a shorter discharge distance in the air, lower supply voltage, maintenance-free by virtue of no deposition of contamination on the electrifying member due to discharge, and a homogeneous electrification potential on the photoconductor. These advantages can achieve an electrophotographic device that is compact, low in price, and low in environmental pollution. Therefore, the contact electrification method is the mainstream method in medium to small-sized devices.

In a reverse development process, dark potential corresponds to a white field on an image, and bright potential corresponds to a black field. If the surface of the conductive substrate has structural defects such as significant irregularities or defects involving in inhomogeneity of material such as precipitation of impurities, these defects emerge as image defects such as black spots or fogging in the white field. These image defects can be considered to occur through local drop of the electrified potential at the location of the defects on the conductive substrate at which charge injection takes place into the photosensitive layer from the substrate due to the defects on the substrate. This tendency is particularly significant in electrophotographic devices employing both the reverse development system and the contact electrification system because of direct contact between the photoconductor and the electrifying member.

To address this problem in electrophotographic devices employing contact electrification system, an undercoat layer is generally provided between the conductive substrate and the photosensitive layer. The undercoat layer is composed of, for example, an anodic oxide film of aluminum, a boehmite film, or a resin film of poly(vinyl alcohol), casein, poly(vinyl pyrrolidone), poly(acrylic acid), gelatin, polyurethane, or polyamide. The resin film can contain particles of metal oxide such as titanium oxide or zinc oxide for the purpose of suppressing excessive reflection of exposure light from the substrate and avoiding a poor image due to interference fringes, and for appropriately adjusting the resistivity of the undercoat layer. The anodic oxide film, in particular, is known to give excellent stability of electrical potential under an environment of high temperature and high humidity, as disclosed in Japanese Unexamined Patent Publication No. H5-34964. A copolymerized nylon film is also widely used for an undercoat layer because it can provide a uniform thickness by means of dip coating and exhibits desirable mass-production and low price. International Patent Publication No. WO 85/00437 discloses a photoconductor for rear surface exposure using caprolactam as a component monomer for copolymerized nylon resin.

An undercoat layer currently in use has the problem that the electric properties change remarkably in the environment of operation, especially in an environment of high temperature and high humidity, and the electric resistivity changes due to moisture absorption in the undercoat layer causing fogging in the image. To cope with this problem, Japanese Unexamined Patent Publication No. S63-298251, for example, discloses use of an intermediate layer including a resin layer containing titanium oxide for the purpose of suppressing the environmental dependence. This document, however, only discloses an embodiment using a nylon resin having a special structure. Japanese Unexamined Patent Publication No. 2003-287914, discloses use of an intermediate layer including a polyamide resin of special structure to improve resistance to moisture. The document, however, fails to disclose an aromatic ring in the dicarboxylic structure in the component monomer and does not mention an effect from adding a monomer of aromatic dicarboxylic acid.

There is a further cause of image defects including black dots and fogging in a white field, that is, aggregation of metal oxide used in the undercoat layer. The aggregate, when it exists in the coating liquid, is also included in the film in the process of application and becomes a passageway for charges causing microscopic leak of charges towards the surface of the photosensitive layer. Thus, poor images result similar to image faults due to defects on the substrate.

Of the aggregates, coarse primary particles can be removed rather readily from coating liquid by a process of filtration, for example, while secondary particles, being formed by a relatively weak force of aggregation, cannot be removed. Therefore, it is important to avoid the formation of secondary particles by finding a composition that inhibits generation of such particles, by improving dispersion capability of the metal oxide, and by establishing an interaction with the resin to maintain a stable dispersion.

SUMMARY OF THE INVENTION

It is therefore an object of the present invention to provide an electrophotographic photoconductor free of image defects such as black spots and fogging on a white field caused by secondary aggregates in an undercoat layer by suppressing generation of such secondary aggregates.

To achieve the object, the inventors of the present invention have made extensive studies and found that a photoconductor generating no image defects, such as black spots or fogging on a white field due to secondary aggregates in the undercoat layer, can be obtained by using a polyamide resin synthesized from specified raw materials in the undercoat layer and by adding metal oxide in combination with and dispersed in the polyamide resin. Here, acid value and base value of the polyamide resin and the metal oxide need to be controlled in an appropriate range. These findings lead to the invention. Regarding this point, the references mentioned above do not mention the acid value or base value of the metal oxide or the polyamide resin, and do not disclose the importance of these values for maintaining a stable dispersion.

An electrophotographic photoconductor according to the present invention comprises an undercoat layer and a photosensitive layer sequentially formed over a conductive substrate, wherein the undercoat layer is mainly composed of a resin and contains a metal oxide, the resin being produced by mixing and polymerizing raw materials of aromatic dicarboxylic acid in a range of 0.1 to 10 mol %, two or more types of dicarboxylic acid other than the aromatic dicarboxylic acid, two or more types of diamine, and at least one type of cyclic amide compound, and the resin exhibiting an acid value and a base value each of at most 6.0 KOH mg/g.

The resin in the invention preferably is produced by mixing and polymerizing raw materials of aromatic dicarboxylic acid in a range of 0.1 to 10 mol %, two or more types of dicarboxylic acid other than the aromatic dicarboxylic acid, two or more types of diamine, and at least one type of cyclic amide compound of at least 10 mol %, and a total amount A, in mol %, of the aromatic dicarboxylic acid and the two or more types of dicarboxylic acid other than the aromatic dicarboxylic acid, and a total amount B, in mol %, of the two or more types of diamine satisfy formula (1):

$$-1.0 \text{ mol } \% \leqq A-B \leqq 1.0 \text{ mol } \% \quad (1)$$

The above-described features of the invention provide an electrophotographic photoconductor free of image defects such as black spots and fogging on a white field caused by secondary aggregates in an undercoat layer, by suppressing generation of such secondary aggregates. Therefore, an electrophotographic apparatus provided with an electrophotographic photoconductor according to the invention provides good images without fogging and black spots even in an environment of high temperature and high humidity, as well as in a normal operational environment.

DETAILED DESCRIPTION OF THE INVENTION

Figure 1:
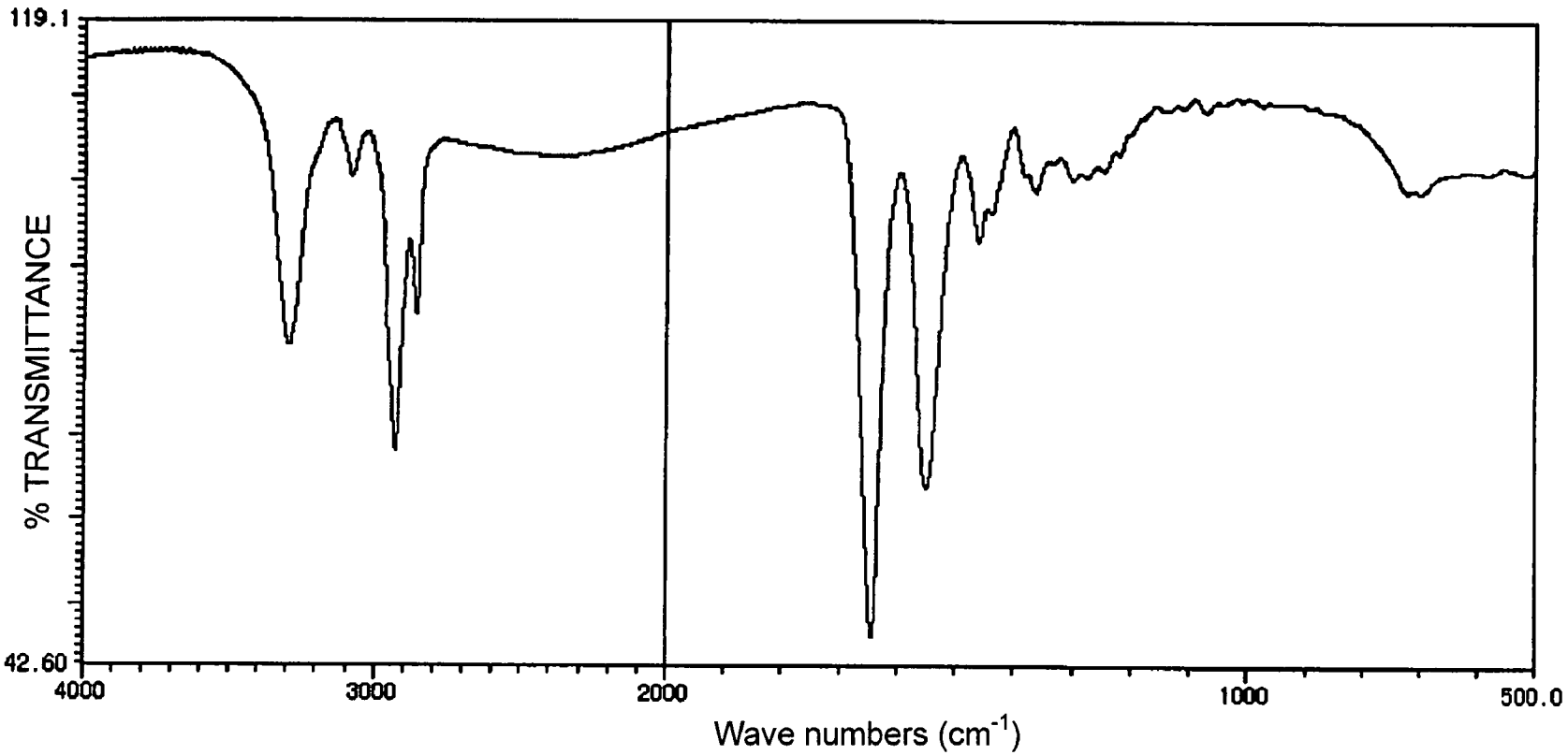
FIG. 1 shows an infrared absorption spectrum of the resin obtained in Example 1.

Now, some preferred embodiments according to the invention will be described in detail in the following.

An electrophotographic photoconductor of the invention comprises an undercoat layer and a photosensitive layer sequentially laminated over a conductive substrate, and the undercoat layer has features described in detail in the following.

An undercoat layer of a photoconductor according to the invention is mainly composed of a resin and contains a metal oxide, the resin being produced by mixing and polymerizing raw materials of aromatic dicarboxylic acid in a range of 0.1 to 10 mol %, two or more types of dicarboxylic acid other than the aromatic dicarboxylic acid, two or more types of diamine, and at least one type of cyclic amide compound, and the resin exhibiting an acid value and a base value each of at most 6.0 KOH mg/g. In the raw materials of the resin in the invention, the denominator of the concentration of each component is the sum of the raw materials of the resin.

The polymerizing reaction employed in the invention is polymerization through dehydration condensation between a carboxylic acid and an amine. Theoretically, an acid value and a base value become the lower limit value that is approximately zero, when all raw materials react to form one polymer molecule. Nevertheless, a resin for forming an undercoat layer obtained by the reaction must have such a molecular weight that allows the obtained resin to dissolve in a solvent. So, the acid value and the base value become a somewhat larger value than the lower limit value. In the invention, the acid value and the base value are allowed to be not larger than 6.0 KOH mg/g and give solubility in a solvent, and a lower limit value is not specified.

The resin used in the undercoat layer in the invention is produced by mixing and polymerizing the raw materials of aromatic dicarboxylic acid in a range of 0.1 to 10 mol %, two or more types of dicarboxylic acid other than the aromatic dicarboxylic acid, two or more types of diamine, and at least one type of cyclic amide compound of at least 10 mol %, and a total amount A, in mol %, of the aromatic dicarboxylic acid and the two or more types of dicarboxylic acid other than the aromatic dicarboxylic acid, and a total amount of B, in mol %, of the two or more types of diamine satisfy formula (1):

$$-1.0 \text{ mol } \% \leqq A-B \leqq 1.0 \text{ mol } \% \quad (1)$$

If A and B do not satisfy the relation (1) above, which means one of the molar numbers of dicarboxylic acid and diamine is much larger than the other, either the acid value or the base value becomes too large after the reaction to confine the acid value and the base value each within 6.0 KOH mg/g. Consequently, poor dispersion capability results.

Preferably, the resin is produced by mixing and polymerizing raw materials of the aromatic dicarboxylic acid, two types of the dicarboxylic acid other than the aromatic dicarboxylic acid, two types of diamine, and one type of cyclic amide compound. More preferably, the resin is produced by mixing and polymerizing raw materials of the aromatic dicarboxylic acid in a range of 1.0 to 10 mol %, two types of dicarboxylic acid other than the aromatic dicarboxylic acid, two types of diamine, and one type of cyclic amide compound in a range of at least 10 mol %, and a total amount A, in mol %, of the aromatic dicarboxylic acid and the two types of dicarboxylic acid other than the aromatic dicarboxylic acid, and a total amount of B, in mol %, of the two types of diamine satisfy formula (1) above.

The amount of the aromatic dicarboxylic acid in the raw materials of the resin necessarily ranges from 0.1 to 10 mol %, and preferably ranges from 2 to 8 mol %. An unduly small amount of the aromatic dicarboxylic acid increases moisture absorption by the resin and causes excessive environmental change of the electrical performance of the photoconductor, resulting in fogging and black spots under a high temperature and humidity environment. On the other hand, an amount of the aromatic dicarboxylic acid over 10 mol % deteriorates dispersion capability.

An aromatic dicarboxylic acid used in the invention has preferably a structure represented by the formula (2):

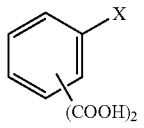

(2)

where X represents a hydrogen atom, an alkyl group, an allyl group, a halogen atom, an alkoxy group, an aryl group, or an alkylene group. Preferred material includes phthalic acid, isophthalic acid, terephthalic acid, and alkyl, allyl, halogen, aryl, and alkylene compounds thereof. More preferred materials among them are phthalic acid, isophthalic acid, terephthalic acid, and fluoride, chloride and bromide thereof.

The two or more types of dicarboxylic acid other than the aromatic dicarboxylic acid, especially two types of dicarboxylic acid other than the aromatic dicarboxylic acid, can be a combination of dicarboxylic acids of a carbon number of 2 to 12 without an aromatic ring. Specific dicarboxylic acids can be selected from aliphatic dicarboxylic acids including butane dioic acid, pentane dioic acid, adipic acid, heptane dioic acid, suberic acid, azelaic acid, decane dioic acid, sebacic acid, dodecane dioic acid. Particularly favorable among these substances is a combination of adipic acid and sebacic acid.

The two or more types of, especially two types of, diamine can be a combination of diamines of a carbon number of 2 to 12. A specific diamine can be selected from aliphatic diamines including ethylene diamine, propylene diamine, tetramethylene diamine, hexamethylene diamine, nonamethylene diamine and undecamethylene diamine, and alicyclic diamine such as 5-amino-1,3,3-trimethyl cyclohexanemethyl amine (also referred to as isophorone diamine). Particularly favorable among these substances is a combination of hexamethylene diamine and isophorone diamine.

The at least one type of, especially one type of, the cyclic amide compound can be a cyclic amide compound of a carbon number of 2 to 12, or a combination thereof. A specific cyclic amide compound can be selected from β-propionic lactam, 2-pyrrolidone, ω-enanthic lactam, ϵ-caprolactam, undecalactam, and dodecalactam, among which ϵ-caprolactam is preferable. Amount of the at least one type of cyclic amide compound in the raw materials is preferably at least 10 mol %. Content under 10 mol % results in poor solubility of the obtained polymer and such a polymer is not useful in a coating liquid for an underlayer.

The following shows examples of polymerization of resins using these raw materials.

In the first step, raw materials selected from the above exemplified substances are mixed in a proportion according to formula (1), and a condensation polymerization reaction is carried out in a reactor vessel running a nitrogen gas flow at a normal pressure and heating up to a temperature ranging from 200 to 350° C. Then, the pressure is reduced and the reaction is continued at the same temperature for several additional hours. An acid value and a base value are measured by means of titration of the obtained resin, to check if both the acid value and the base value are not larger than 6.0 KOH mg/g. When either one or both of the acid value and the base value are larger than 6.0 KOH mg/g, a good dispersion characteristic cannot be achieved, so, the reaction would need to be continued. Measurements of $H^1$-NMR and $C^{13}$-NMR can check if a target copolymer is produced according to the proportion of raw materials.

An undercoat layer produced by dispersing metal oxide in a resin that is obtained by the above described polymerization and exhibiting an acid value and a base value of at most 6.0 KOH mg/g according to the invention can inhibit generation of image defects such as black spots and fogging in a white field caused by secondary aggregations in the undercoat layer.

The metal oxide for use in the invention can be selected from titanium oxide, zinc oxide, tin oxide, copper oxide, aluminum oxide and magnesium oxide. Alternatively, silicon oxide can be employed instead of a metal oxide. References herein to a metal oxide shall also be taken to include silicon oxide. Surface treatment can be implemented on the metal oxide to improve its dispersion characteristics, preferably with a coupling agent, such as, for example, organic silane, where the organic silane may be selected from the group consisting of an aminosilane, an isobutylsilane, and mixtures thereof.

The metal oxide preferably exhibits an acid value and a base value each not larger than 20.0 KOH mg/g. If the acid value or the base value of the metal oxide dispersed in an undercoat layer is larger than 20 KOH mg/g, dispersion characteristics in the resin of the undercoat layer deteriorate and a poor image may result.

In measuring the acid value of metal oxide, a sample is added into a butyl amine-methanol solution in a known concentration, followed by ultrasonic dispersion for 1 hr. Titration is conducted on the supernatant liquid after centrifugation. Simultaneously, a blank test is conducted and the amount of consumed butyl amine is represented in KOH mg/g (consumed quantity in mg per 1 g converted to KOH). A base value is measured by adding a sample into an acetic acid-methanol solution in a known concentration, followed by ultrasonic dispersion for 1 hr. Titration is conducted on the supernatant liquid after centrifugation. Simultaneously, a blank test is conducted and the amount of consumed acetic acid is represented in KOH mg/g (consumed quantity in mg per 1 g converted to KOH).

In a photoconductor of the invention, the constitution of the layers other than the undercoat layer is not unduly constrained so long as the undercoat layer satisfies the above described conditions and can be evaluated according to the normal method. The photosensitive layer has a structure which is either a functionally separated structure consisting of a charge generation layer and a charge transport layer, or a single layer structure consisting of a single photosensitive layer. The following description of layer structure will be made for an example of the functionally separated lamination type.

The conductive substrate can be a drum composed of a metal such as aluminum, or a film of conductive plastics. Alternately, a glass or a molded material or a sheet made of acrylic resin, polyamide, or poly(ethylene terephthalate) can also be used with an electrode provided on the surface thereof.

The charge generation layer can be composed of a charge generation material of organic pigment together with a resin binder. Preferred charge generation material can be selected from metal free phthalocyanines having various crystal forms, and various phthalocyanines having a central metal of copper, aluminum, indium, vanadium, or titanium, and bisazo and trisazo pigments. These organic pigments have particle diameters ranging from 50 to 800 nm, preferably ranging from 150 nm to 300 nm, and are dispersed in a binder resin.

Performance of the charge generation layer is affected by a binder resin. The binder resin is appropriately selected from poly(vinyl chloride), poly(vinyl butyral), poly(vinyl acetal), polyester, polycarbonate, acrylic resin, and phenoxy resin without any special constraints. The charge generation layer has a thickness which preferably ranges from 0.1 to 5 μm, and more preferably ranges from 0.2 to 0.5 μm.

To achieve a favorable dispersion condition and form a homogeneous charge generation layer, a solvent for the coating liquid must be adequately selected. The solvent in the invention can be selected from aliphatic hydrocarbon halides such as methylene chloride and 1,2-dichroloethane, etherized hydrocarbons such as tetrahydrofuran, ketones such as acetone, methyl ethyl ketone, and cyclohexanone, and esters such as ethyl acetate and ethyl cellosolve. The proportion of the charge generation agent and binder resin in the coating liquid are preferably adjusted such that the binder resin ranges from 30 to 70 wt % in the charge generation layer after coating and drying. A particularly favorable composition of the charge generation layer is 50 wt % of binder resin and 50 wt % of charge generation agent.

The materials as described above are appropriately combined to prepare a coating liquid for a charge generation layer. The coating liquid is then treated with an apparatus for dispersion treatment, such as a ball mill or a paint shaker, to adjust the grain diameter of the pigment particles to a desired size, and used in the coating process.

A charge transport layer can be formed by applying charge transport material alone or a coating liquid containing a charge transport material and a binder resin dissolved in an adequate solvent. The application process is conducted on the charge generation layer by a dipping process or a process using an applicator, followed by a drying process to obtain a charge transport layer. A charge transport material can be appropriately selected from hole transport substances or electron transport substances according to the system for electrifying the photoconductor in copiers, printers, or facsimile machines. These substances can be adequately selected from known materials, for example see: Borsenberger, P. M., and Weiss, D. S. eds. "Organic Photoreceptors for Imaging Systems", Marcel Dekker Inc., 1993. Such hole transport materials include hydrazone compounds, styryl compounds, diamine compounds, butadiene compounds, indole compounds, and a mixture of these materials. The electron transport materials include benzoquinone derivatives, phenanthrenequinone derivatives, stilbenequinone derivatives, and azaquinone derivatives.

For a binder resin to form a charge transport layer together with the charge transport agent, polycarbonate polymers are commonly used from the viewpoints of film strength and wear resistance. The polycarbonate polymers include bisphenols A, C, and Z. Copolymers consisting of monomer units composing these polycarbonate polymers can be also used. Adequate molecular weight of the polycarbonate polymers ranges from 10,000 to 100,000. Other substances that can be used for binder resin in a charge transport layer include polyethylene, polyphenylene ether, acrylic resin, polyester, polyamide, polyurethane, epoxy resin, poly(vinyl acetal), poly(vinyl butyral), phenoxy resin, silicone resin, poly(vinyl chloride), poly(vinylidene chloride), poly(vinyl acetate), cellulose resin, and copolymers of these substances.

Thickness of the charge transport layer is preferably in the range of 3 to 50 μm considering electrification characteristics and wear resistance of the photoconductor. Silicone oil can be adequately added to promote surface smoothness. A surface protective layer can be additionally provided on the charge transport layer as required.

A photosensitive layer in a single layer type photoconductor is mainly composed of a charge generation material, a hole transport material, an electron transport material (a compound with an acceptor characteristic), and a resin binder. The charge generation material can be selected from the organic pigments similar to those in the laminated type photoconductor, preferably from metal-free phthalocyanines having various crystal forms, phthalocyanines having a central metal of copper, aluminum, indium, vanadium, or titanium, and bisazo and trisazo pigments.

A hole transport material can be selected from hydrazone compounds, styryl compounds, diamine compounds, butadiene compounds, indole compounds, or a mixture of these compounds. An electron transport material can be selected from benzoquinone derivatives, phenanthrenequinone derivatives, stilbenequinone derivatives, azoquinone derivatives, and combinations of these materials.

A resin binder can be composed of a polycarbonate resin alone or in an appropriate combination with a resin selected from polyester resin, poly(vinyl acetal) resin, poly(vinyl butyral) resin, poly(vinyl alcohol) resin, vinyl chloride resin, vinyl acetate resin, polyethylene, polypropylene, polystylene, acrylic resin, polyurethane resin, epoxy resin, melamine resin, silicone resin, polyamide resin, polystyrene resin, polyacetal resin, polyallylate resin, polysulfone resin, polymer of methacrylate, and copolymers of these resins. A mixture of the same type resins having different molecular weight can also be used.

Thickness of a single layer type photosensitive layer is preferably in the range of 3 to 100 μm, more preferably in the range of 10 to 50 μm, to maintain a practically effective surface potential. Silicone oil can be adequately added to promote surface smoothness. A surface protective layer can be provided on the photosensitive layer as required.

EXAMPLES

The present invention will be described more in detail with reference to specific embodiment examples. The invention, however, shall not be limited to those examples.

Example 1

Figure 2:
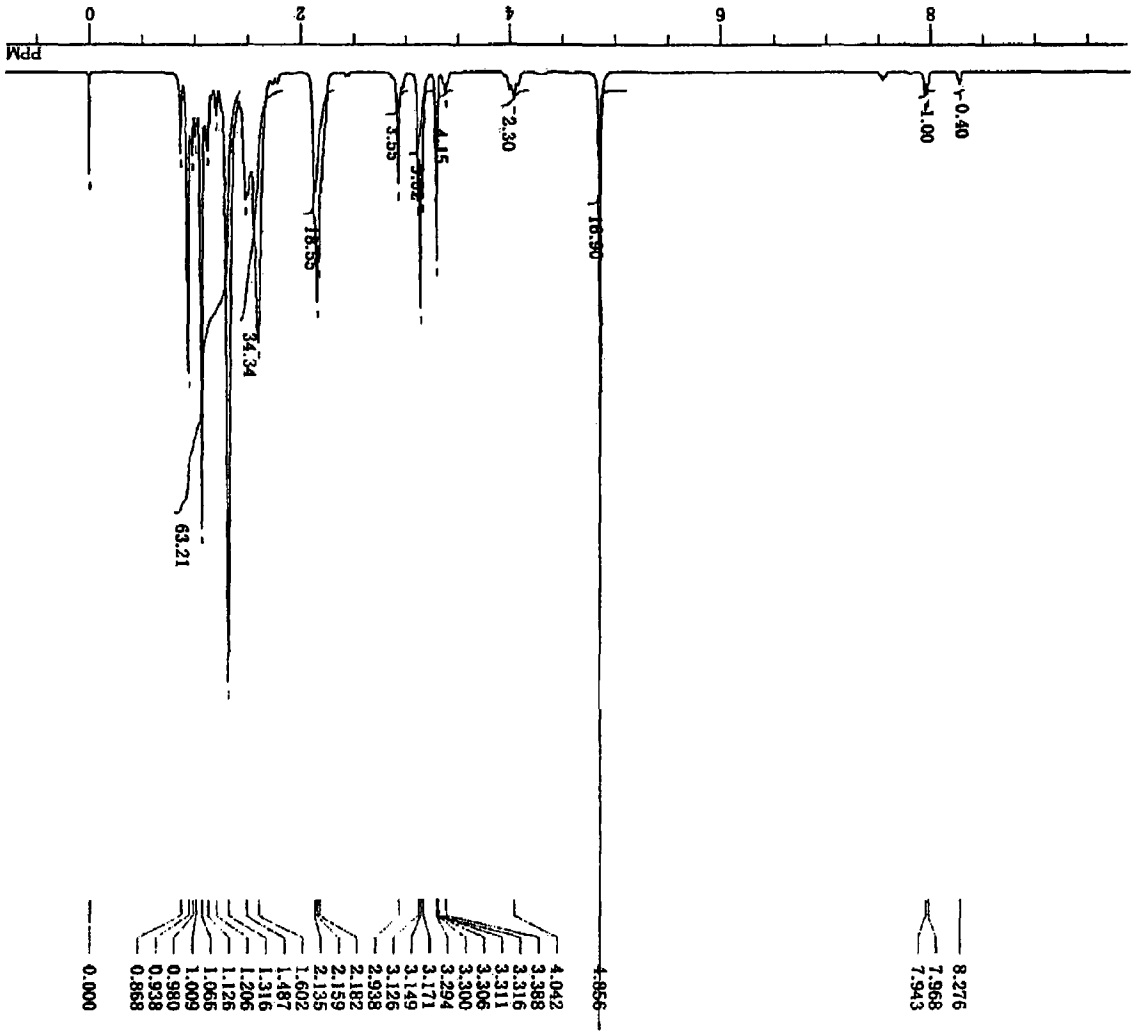
FIG. 2 is an $H^1$-NMR chart of the resin obtained in Example 1.

Raw materials used for the resin were: 4 mol % of isophthalic acid, 15 mol % of hexamethylene diamine, 11 mol % of adipic acid, 25 mol % of sebacic acid, 25 mol % of isophorone diamine, and 20 mol % of ϵ-caprolactam. These materials adjusted to the total weight of 1 kg were mixed in a four-neck flask of 2,000 mL. The temperature was raised to 220° C. with nitrogen flow in a reaction vessel. Collecting a distillated water component, the temperature was further raised to 300° C. and the reaction was continued until the distillation terminated. After the water component ceased to distillate, the pressure in the vessel was reduced and the polymerization reaction was further continued, to obtain a resin of Example 1. An infrared absorption spectrum of the obtained resin is shown in FIG. 1, and an $H^1$-NMR chart of the obtained resin is shown in FIG. 2.

An amount of 0.5 g of the obtained resin was dissolved in 30 mL of methanol and, then, titrated with a 0.5 mol % KOH-ethanol solution using an indicator of phenol phthalein. After a blank test, an acid value was calculated from the difference between the titration quantities in the sample and the blank test.

Similarly, 0.5 g of the resin was dissolved in 30 mL of methanol and, then, titrated with a 0.5 mol % HCl-ethanol solution using an indicator of thymol blue. After a blank test, a base value was calculated from the measured titration quantities.

The resulting acid value of the obtained resin was 2.11 KOH mg/g, and the base value was 1.56 KOH mg/g.

An amount of 100 parts by weight of the resin was dissolved in a mixed solution of 1,500 parts by weight of methanol and 500 parts by weight of butanol, and 400 parts by weight of titanium oxide was added, which was fine particles of titanium oxide JMT150 produced by Tayca Corporation, and treated with an aminosilane coupling agent and an isobutylsilane coupling agent in a ratio of 1/1. Thus, slurry was produced. The acid value of the titanium oxide was 0.20 KOH mg/g, and the base value was 5.70 KOH mg/g. The obtained slurry was treated using a disk-type bead mill filled with zirconia beads having a bead diameter of 0.3 mm in a volumetric filling factor of 85 v/v % with respect to the vessel capacity, and circulating a 20 times quantity of the treatment liquid at a flow rate of the treatment liquid of 400 mL/min and a disk circumferential speed of 5 m/s. The coating liquid for an undercoat layer was thus prepared.

Using the thus prepared coating liquid, a film of an undercoat layer was formed on a drum type aluminum substrate by means of a dip coating method. After drying under conditions of a drying temperature of 135° C. and a drying time of 10 min, an undercoat layer having a dried thickness of 5 μm was obtained.

Then, 5 L of slurry was produced by dissolving 1 part by weight of poly(vinyl butyral) resin in 98 parts by weight of dichloromethane and adding 2 parts by weight of α type titanyl phthalocyanine that was disclosed in Japanese Unexamined Patent Publication No. S61-217050. The thus obtained slurry was treated using a disk-type bead mill filled with zirconia beads having a bead diameter of 0.4 mm in a volumetric filling factor of 85 v/v % with respect to the vessel capacity, and circulating a ten times quantity of the treatment liquid at a flow rate of the treatment liquid of 300 mL/min and a disk circumferential speed of 3 m/s. The coating liquid for a charge generation layer was thus prepared.

Using the thus obtained coating liquid for a charge generation layer, a charge generation layer was formed on a previously applied undercoat layer of a substrate. After drying under conditions of a drying temperature of 80° C. and a drying time of 30 min, a charge generation layer having a thickness 0.5 μm was obtained.

Charge transport materials of 5 parts by weight of the compound represented by structural formula (3) and 5 parts by weight of the compound represented by structural formula (4), and a resin binder of 10 parts by weight of a polycarbonate resin (TOUGHZET® B-500, a product of Idemitsu Kosan Co., Ltd) were dissolved in 80 parts by weight of dichloromethane. Adding 0.1 parts by weight of a silicone oil (KP-340, a product of Shin'etsu Polymer Co., Ltd.) into this solution completed preparation of a coating liquid for a charge transport layer. This coating liquid was dip-coated onto the charge generation layer, and then dried at a temperature of 90° C. for 60 mm to form a charge transport layer 25 μm thick. An electrophotographic photoconductor was thus produced.

(3)

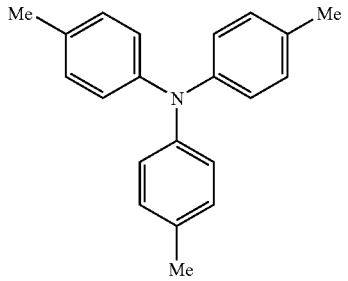

(4)

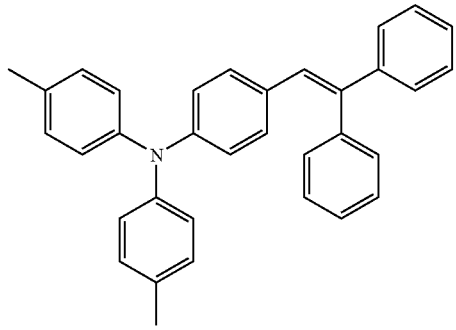

Example 2

The resin of Example 2 was obtained in the same manner as in Example 1 except that the raw materials used in Example 2 were: 2 mol % of isophthalic acid, 15 mol % of hexamethylene diamine, 13 mol % of adipic acid, 25 mol % of sebacic acid, 25 mol % of isophorone diamine, and 20 mol % of ϵ-caprolactam. The acid value of the obtained resin was 2.10 KOH mg/g and the base value was 3.51 KOH mg/g. A coating liquid for an undercoat layer was prepared using this resin in a manner similar to that in Example 1, and a photoconductor was produced similarly to that in Example 1.

Example 3

The resin in Example 3 was obtained in the same manner as in Example 1 except that the raw materials used in Example 3 were: 8 mol % of isophthalic acid, 15 mol % of hexamethylene diamine, 9 mol % of adipic acid, 23 mol % of sebacic acid, 25 mol % of isophorone diamine, and 20 mol % of ϵ-caprolactam. Then acid value of the obtained resin was 3.95 KOH mg/g and the base value was 4.5 KOH mg/g. A coating liquid for an undercoat layer was prepared using this resin in a manner similar to that in Example 1, and a photoconductor was produced similarly to that in Example 1.

Example 4

The resin in Example 4 was obtained in the same manner as in Example 1 except that the raw materials used in Example 4 were: 0.1 mol % of isophthalic acid, 15 mol % of hexamethylene diamine, 14.9 mol % of adipic acid, 25 mol % of sebacic acid, 25 mol % of isophorone diamine, and 20 mol % of ϵ-caprolactam. The acid value of the obtained resin was 3.20 KOH mg/g and the base value was 4.00 KOH mg/g. A coating liquid for an undercoat layer was prepared using this resin in a manner similar to that in Example 1, and a photoconductor was produced similarly to that in Example 1.

Example 5

The resin in Example 5 was obtained in the same manner as in Example 1 except that the raw materials used in Example 5 were: 10 mol % of isophthalic acid, 15 mol % of hexamethylene diamine, 8 mol % of adipic acid, 22 mol % of sebacic acid, 25 mol % of isophorone diamine, and 20 mol % of ϵ-caprolactam. The acid value of the obtained resin was 4.52 KOH mg/g and the base value was 4.10 KOH mg/g. A coating liquid for an undercoat layer was prepared using this resin in a manner similar to that in Example 1, and a photoconductor was produced similarly to that in Example 1.

Example 6

The resin in Example 6 was obtained in the same manner as in Example 1 except that the raw materials used in Example 6 were: 4 mol % of isophthalic acid, 20 mol % of hexamethylene diamine, 16 mol % of adipic acid, 25 mol % of sebacic acid, 25 mol % of isophorone diamine, and 10 mol % of ϵ-caprolactam. The acid value of the obtained resin was 2.30 KOH mg/g and the base value was 2.10 KOH mg/g. A coating liquid for an undercoat layer was prepared using this resin in a manner similar to that in Example 1, and a photoconductor was produced similarly to that in Example 1.

Example 7

The resin in Example 7 was obtained in the same manner as in Example 1 except that the raw materials used in Example 7 were: 2 mol % of isophthalic acid, 10 mol % of hexamethylene diamine, 8 mol % of adipic acid, 20 mol % of sebacic acid, 20 mol % of isophorone diamine, and 40 mol % of ϵ-caprolactam. The acid value of the obtained resin was 2.90 KOH mg/g and the base value was 3.10 KOH mg/g. A coating liquid for an undercoat layer was prepared using this resin in a manner similar to that in Example 1, and a photoconductor was produced similarly to that in Example 1.

Example 8

The resin used in Example 8 was obtained in the process of mixing and heated polymerization of the raw materials that were used in Example 1, when the acid value reached the value of 6.00 KOH mg/g and the base value reached the value of 6.00 KOH mg/g in the polymerization process. A coating liquid for an undercoat layer was prepared using this resin in a manner similar to that in Example 1, and a photoconductor was produced similarly to that in Example 1.

Example 9

The resin in Example 9 was obtained in the same manner as in Example 1 except that the raw materials used in Example 9 were: 4 mol % of isophthalic acid, 14.5 mol % of hexamethylene diamine, 11.5 mol % of adipic acid, 25 mol % of sebacic acid, 25 mol % of isophorone diamine, and 20 mol % of ϵ-caprolactam. The acid value of the obtained resin was 5.95 KOH mg/g and the base value was 0.45 KOH mg/g. A coating liquid for an undercoat layer was prepared using this resin in a manner similar to that in Example 1, and a photoconductor was produced similarly to that in Example 1.

Example 10

The resin in Example 10 was obtained in the same manner as in Example 1 except that the raw materials used in Example 10 were: 4 mol % of isophthalic acid, 15.5 mol % of hexamethylene diamine, 10.5 mol % of adipic acid, 25 mol % of sebacic acid, 25 mol % of isophorone diamine, and 20 mol % of ϵ-caprolactam. The acid value of the obtained resin was 0.52 KOH mg/g and the base value was 5.82 KOH mg/g. A coating liquid for an undercoat layer was prepared using this resin in a manner similar to that in Example 1, and a photoconductor was produced similarly to that in Example 1.

Example 11

A coating liquid for an undercoat layer was prepared in the same manner as in Example 1 except that the titanium oxide used in Example 1 was replaced by 400 g of aminosilane-treated titanium oxide, i.e., fine particles of oxide of titanium JMT500 produced by Tayca Corporation. A photoconductor was produced using this coating liquid. The acid value of the titanium oxide was 2.00 KOH mg/g and the base value was 1.00 KOH mg/g.

Example 12

A coating liquid for an undercoat layer was prepared in the same manner as in Example 1 except that the titanium oxide used in Example 1 was replaced by tin oxide, i.e., fine particles of tin oxide produced by C.I. Kasei Co., Ltd., that was treated with an aminosilane coupling agent and an isobutylsilane coupling agent in a ratio of 1/1. A photoconductor was produced using this coating liquid. The acid value of the tin oxide was 5.00 KOH mg/g and the base value was 5.70 KOH mg/g.

Comparative Example 1

The resin in Comparative Example 1 was obtained in the same manner as in Example 1 except that the raw materials used in Comparative Example 1 were: 12 mol % of isophthalic acid, 15 mol % of hexamethylene diamine, 7 mol % of adipic acid, 21 mol % of sebacic acid, 25 mol % of isophorone diamine, and 20 mol % of ϵ-caprolactam. The acid value of the obtained resin was 4.20 KOH mg/g and the base value was 4.50 KOH mg/g. A coating liquid for an undercoat layer was prepared using this resin in a manner similar to that in Example 1, and a photoconductor was produced similarly to that in Example 1.

Comparative Example 2

The resin in Comparative Example 2 was obtained in the same manner as in Example 1 except that the raw materials used in Comparative Example 2 were: 4 mol % of isophthalic acid, 14 mol % of hexamethylene diamine, 12 mol % of adipic acid, 25 mol % of sebacic acid, 25 mol % of isophorone diamine, and 20 mol % of ϵ-caprolactam. The acid value of the obtained resin was 13.2 KOH mg/g and the base value was 0.40 KOH mg/g. A coating liquid for an undercoat layer was prepared using this resin in a manner similar to that in Example 1, and a photoconductor was produced similarly to that in Example 1.

Comparative Example 3

The resin in Comparative Example 3 was obtained in the same manner as in Example 1 except that the raw materials used in Comparative Example 3 were: 4 mol % of isophthalic acid, 16 mol % of hexamethylene diamine, 10 mol % of adipic acid, 25 mol % of sebacic acid, 25 mol % of isophorone diamine, and 20 mol % of ϵ-caprolactam. The acid value of the obtained resin was 0.32 KOH mg/g and the base value was 11.9 KOH mg/g. A coating liquid for an undercoat layer was prepared using this resin in a manner similar to that in Example 1, and a photoconductor was produced similarly to that in Example 1.

Comparative Example 4

A coating liquid for an undercoat layer was prepared in the same manner as in Comparative Example 1 except that the titanium oxide used in Comparative Example 1 was replaced by the titanium oxide used in Example 11. A photoconductor was produced using this coating liquid.

Comparative Example 5

A coating liquid for an undercoat layer was prepared in the same manner as in Comparative Example 1 except that the titanium oxide used in Comparative Example 1 was replaced by the tin oxide used in Example 12. A photoconductor was produced using this coating liquid.

Comparative Example 6

The resin in Comparative Example 6 was obtained in the same manner as in Example 1 except that the raw materials used in Comparative Example 6 were: 8 mol % of isophthalic acid, 20 mol % of hexamethylene diamine, 12 mol % of adipic acid, 30 mol % of sebacic acid, 30 mol % of isophorone diamine, and 0 mol % of ϵ-caprolactam. The obtained resin did not exhibit sufficient solubility in the solvent used in Example 1 and did not allow fabrication of an undercoat layer.

Comparative Example 7

A coating liquid for an undercoat layer was prepared in the same manner as in Comparative Example 1 except that the resin used in Comparative Example 1 was replaced by AMILAN® CM8000, a product of Toray Industries Inc. A photoconductor was produced using this coating liquid.

The photoconductors produced in Examples 1 through 12 and Comparative Examples 1 through 7 were installed in a commercially available printer and image quality was evaluated under various environmental conditions (high temperature and high humidity: 35° C., 85% RH, normal temperature and normal humidity: 25° C., 50% RH, low temperature and low humidity: 5° C., 15% RH). Evaluation of the image data was determined, on the images obtained from the photoconductors that had approximately equivalent electrical characteristics, based on whether or not fogging or a black spot existed in the white field of the image. The results are given in Table 1.

TABLE 1

| | chronological change in undercoat layer liquid | evaluation results on image quality | | |
|---|---|---|---|---|
| | | 35° C., 85% RH | 25° C., 50% RH | 5° C., 15% RH |
| Example 1 | none | good | good | good |
| Example 2 | none | good | good | good |
| Example 3 | none | good | good | good |
| Example 4 | none | good | good | good |
| Example 5 | none | good | good | good |
| Example 6 | none | good | good | good |
| Example 7 | none | good | good | good |
| Example 8 | none | good | good | good |
| Example 9 | none | good | good | good |
| Example 10 | none | good | good | good |
| Example 11 | none | good | good | good |
| Example 12 | none | good | good | good |
| Comp Ex 1 | aggregation and sedimentation occurred | fogging and black spots | black spots | black spots |
| Comp Ex 2 | aggregation and sedimentation occurred | fogging and black spots | fogging and black spots | black spots |
| Comp Ex 3 | aggregation and sedimentation occurred | fogging and black spots | black spots | black spots |
| Comp Ex 4 | aggregation and sedimentation occurred | fogging and black spots | fogging and black spots | black spots |
| Comp Ex 5 | aggregation and sedimentation occurred | fogging and black spots | fogging and black spots | black spots |

TABLE 1-continued

| | chronological change | evaluation results on image quality | | |
|---|---|---|---|---|
| | in undercoat layer liquid | 35° C., 85% RH | 25° C., 50% RH | 5° C., 15% RH |
| Comp Ex 6 | resin was insoluble | evaluation impossible | evaluation impossible | evaluation impossible |
| Comp Ex 7 | gelation after production of photoconductor | fogging and black spots | good | good |

As clearly shown in Table 1, it has been demonstrated that good image quality in widely varying environmental conditions is achieved by every photoconductor of Examples using a resin obtained from raw materials of isophthalic acid, adipic acid, sebacic acid, hexamethylene diamine, isophorone diamine, and ϵ-caprolactam, in which the isophthalic acid is in an amount in the specified range of molar percent, total amount A of molar percentage of the isophthalic acid, the adipic acid, and the sebacic acid and total amount B of molar percentage of the hexamethylene diamine and the isophorone diamine are in the range specified by the formula (1), and the ϵ-caprolactam is in the range of 10% to 40%.

In contrast, a poor dispersion property and deteriorated image performance was obtained for the photoconductors of Comparative Examples 1, 4, and 5 that contained excessive amount of isophthalic acid in the raw material, for the photoconductor of Comparative Example 2 that exhibited a high acid value of the resin, and for the photoconductor of Comparative Example 3 that exhibited a high base value of the resin. The for the photoconductor Comparative Example 7 that uses a commonly used resin without an aromatic component generated black spots under an environmental condition of high temperature and high humidity in particular. These results indicate that such faults may occur in some combinations of a resin and a metal oxide depending on the type and composition of the metal oxide.

While the present invention has been described in conjunction with embodiments and variations thereof, one of ordinary skill after reviewing the foregoing specification will be able to effect various changes, substitutions of equivalents and other alterations without departing from the broad concepts disclosed herein. It is therefore intended that Letters Patent granted hereon be limited only by the definition contained in the appended claims and equivalents thereof.

What is claimed is:

1. An electrophotographic photoconductor, comprising:

a conductive substrate, an undercoat layer and a photosensitive layer sequentially formed over the conductive substrate in the order recited, wherein the undercoat layer is mainly composed of a resin and contains an oxide selected from the group consisting of a metal oxide and silicon oxide, wherein the resin is produced by mixing and polymerizing raw materials comprised of from of 0.1 to 10 mol % of aromatic dicarboxylic acid, two or more dicarboxylic acids other than the aromatic dicarboxylic acid, two or more diamines, and at least one cyclic amide compound, and wherein the resin exhibits an acid value and a base value each of at most 6.0 KOH mg/g.

2. The electrophotographic photoconductor according to claim 1, wherein the resin is produced by mixing and polymerizing raw materials comprised of from 0.1 to 10 mol % of aromatic dicarboxylic acid, the two or more dicarboxylic acids other than the aromatic dicarboxylic acid, the two or more diamines, and at least 10 mol % of the at least one cyclic amide compound, and wherein a total amount A, in mol %, of the aromatic dicarboxylic acid and the two or more dicarboxylic acids other than the aromatic dicarboxylic acid, and a total amount B, in mol %, of the two or more diamines satisfy formula (1):

$$-0.1\ \text{mol}\ \% \leqq A-B \leqq 1.0\ \text{mol}\ \% \quad (1).$$

3. The electrophotographic photoconductor according to claim 2, wherein the aromatic dicarboxylic acid has a structure represented by the formula (2):

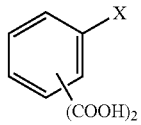

(2)

where X represents a hydrogen atom, an alkyl group, an alkyl group, a halogen atom, an alkoxy group, an aryl group, or an alkylene group.

4. The electrophotographic photoconductor according to claim 1, wherein the resin is produced by mixing and polymerizing raw materials comprised of from 0.1 to 10 mol % of the aromatic dicarboxylic acid, the two dicarboxylic acids other than the aromatic dicarboxylic acid, the two diamines, and only one of the at least one cyclic amide compound.

5. The electrophotographic photoconductor according to claim 4, wherein the aromatic dicarboxylic acid has a structure represented by the formula (2):

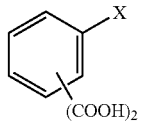

(2)

where X represents a hydrogen atom, an alkyl group, an alkyl group, a halogen atom, an alkoxy group, an aryl group, or an alkylene group.

6. The electrophotographic photoconductor according to claim 4, wherein the resin is produced by mixing and polymerizing raw materials comprised of from 0.1 to 10 mol % of the aromatic dicarboxylic acid, the two dicarboxylic acids other than the aromatic dicarboxylic acid, the two diamines, and at least 10 mol % the only one of the at least one cyclic amide compound, and wherein a total amount A, in mol %, of the aromatic dicarboxylic acid and the two dicarboxylic acids other than the aromatic dicarboxylic acid, and a total amount B, in mol %, of the two diamines satisfy formula (1):

$$-1.0 \text{ mol } \% \leqq A-B \leqq 1.0 \text{ mol } \% \quad (1).$$

7. The electrophotographic photoconductor according to claim 6, wherein the aromatic dicarboxylic acid has a structure represented by the formula (2):

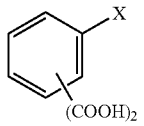

(2)

where X represents a hydrogen atom, an alkyl group, an alkyl group, a halogen atom, an alkoxy group, an aryl group, or an alkylene group.

8. The electrophotographic photoconductor according to claim 1, wherein the aromatic dicarboxylic acid has a structure represented by the formula (2):

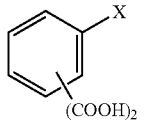

(2)

where X represents a hydrogen atom, an alkyl group, an alkyl group, a halogen atom, an alkoxy group, an aryl group, or an alkylene group.

9. The electrophotographic photoconductor according to claim 8, wherein the aromatic dicarboxylic acid is selected from the group consisting of isophthalic acid, phthalic acid, and terephthalic acid.

10. The electrophotographic photoconductor according to claim 1, wherein the two dicarboxylic acids other than the aromatic dicarboxylic acid consist of a combination of dicarboxylic acids which have a carbon number ranging from 2 to 12 and which do not have an aromatic ring.

11. The electrophotographic photoconductor according to claim 10, wherein the two dicarboxylic acids other than the aromatic dicarboxylic acid consist of a combination of adipic acid and sebacic acid.

12. The electrophotographic photoconductor according to claim 1, wherein the two diamines consist of a combination of diamines having a carbon number ranging from 2 to 12.

13. The electrophotographic photoconductor according to claim 12, wherein the two diamines consist of a combination of hexamethylene diamine and isophorone diamine.

14. The electrophotographic photoconductor according to claim 1, wherein the at least one cyclic amide compound consists of a cyclic amide compound having a carbon number ranging from 2 to 12, or a combination of the at least one cyclic amide compounds.

15. The electrophotographic photoconductor according to claim 14, wherein the at least one cyclic amide compound is ϵ-caprolactam.

16. The electrophotographic photoconductor according to claim 1, wherein the oxide exhibits an acid value and a base value each of at most 20.0 KOH mg/g.

17. The electrophotographic photoconductor according to claim 1, wherein the metal oxide is selected from the group consisting of titanium oxide, zinc oxide, tin oxide, copper oxide, aluminum oxide and magnesium oxide.

18. The electrophotographic photoconductor according to claim 1, wherein the oxide is surface treated to improve dispersion characteristics prior to being dispersed in the resin.

19. The electrophotographic photoconductor according to claim 18, wherein the oxide is surface treated with a coupling agent to improve dispersion characteristics prior to being dispersed in the resin.

20. The electrophotographic photoconductor according to claim 19, wherein the coupling agent is an organic silane selected from the group consisting of an aminosilane, an isobutylsilane, and mixtures thereof.

* * * * *